US009142148B2

(12) United States Patent
Stanton

(10) Patent No.: US 9,142,148 B2
(45) Date of Patent: Sep. 22, 2015

(54) ADJUSTABLE REMINDER LABEL

(71) Applicant: Andrew Stanton, Collinsville, CT (US)

(72) Inventor: Andrew Stanton, Collinsville, CT (US)

( * ) Notice: Subject to any disclaimer, the term of this patent is extended or adjusted under 35 U.S.C. 154(b) by 305 days.

(21) Appl. No.: 13/919,025

(22) Filed: Jun. 17, 2013

(65) Prior Publication Data

US 2014/0007806 A1 Jan. 9, 2014

Related U.S. Application Data

(60) Provisional application No. 61/667,485, filed on Jul. 3, 2012.

(51) Int. Cl.

| | |
|---|---|
| ***G09F 3/00*** | (2006.01) |
| ***A61J 1/03*** | (2006.01) |
| ***G09F 3/08*** | (2006.01) |
| ***A61J 7/04*** | (2006.01) |
| *G09F 3/02* | (2006.01) |

(52) U.S. Cl.

CPC ... *G09F 3/00* (2013.01); *A61J 7/04* (2013.01); *G09F 3/08* (2013.01); *A61J 1/03* (2013.01); *G09F 2003/0219* (2013.01); *G09F 2003/0273* (2013.01)

(58) Field of Classification Search

CPC ..... A61J 1/03; A61J 7/04; G09F 3/00; G09F 3/08; G09F 11/00; G09F 2003/0219; G09F 2003/0273

USPC ..... 116/222, 224, 225, 234, 235, 238, 239, 116/307, 308, 309, 311, 312, 313, 314, 315, 116/316, 317, 318, 321, 322, 323, 324

See application file for complete search history.

(56) References Cited

U.S. PATENT DOCUMENTS

| | | | | | |
|---|---|---|---|---|---|
| 2,704,048 | A | * | 3/1955 | Perier | 116/324 |
| 2,888,899 | A | * | 6/1959 | Graham | 116/324 |
| 3,996,879 | A | * | 12/1976 | Walton | 116/308 |
| 4,172,595 | A | * | 10/1979 | Sewell | 473/553 |
| 4,189,143 | A | * | 2/1980 | Van Auken et al. | 116/222 |
| 4,625,675 | A | * | 12/1986 | Rosenberg | 116/324 |
| 4,682,430 | A | * | 7/1987 | Ramsay | 40/5 |
| 4,703,712 | A | * | 11/1987 | Christman | 116/324 |
| 4,738,449 | A | * | 4/1988 | Droz | 473/553 |
| 5,048,452 | A | * | 9/1991 | Haddock et al. | 116/225 |
| 5,062,381 | A | * | 11/1991 | Hendricks | 116/225 |
| 5,253,441 | A | * | 10/1993 | Rachiele et al. | 40/488 |

(Continued)

FOREIGN PATENT DOCUMENTS

| | | | | |
|---|---|---|---|---|
| WO | WO 9902118 A1 | * | 1/1999 | A61J 1/03 |

*Primary Examiner* — R. A. Smith

(74) *Attorney, Agent, or Firm* — The IP Law Firm of Guy Levi, LLC; Guy Levi

(57) ABSTRACT

The disclosure is directed to a reminder label, specifically to a thermoplastic adjustable reminder label that is configured to indicate removal of content from a bottle to which the thermoplastic reminder label is coupled. The label has a flanged thermoplastic knob extending above a rectangular flange with a longitudinal axis and a transverse axis perpendicular to the longitudinal axis. A pair of resilient units is coupled to the flange along transverse sides and extends beyond the transverse sides. Each resilient member terminates in protrusions to engage parallel grooves etched internally in each of longitudinal parallel walls (101, 102) of a housing (130). A flap (110) is hingedly coupled to a housing base frame (140) to frictionally engage the housing and form a floor.

20 Claims, 4 Drawing Sheets

(56) References Cited

U.S. PATENT DOCUMENTS 6,058,640 A * 5/2000 Young ..... 40/709
7,614,358 B2 * 11/2009 Duer ..... 116/324
D730,990 S * 6/2015 Stanton ..... D20/18
2008/0168940 A1 * 7/2008 Duer et al. ..... 116/324

* cited by examiner

ADJUSTABLE REMINDER LABEL

CROSS REFERENCE TO RELATED APPLICATIONS

This application claims priority from U.S. Provisional Application No. 61/667,485 filed Jul. 3, 2012, the content of which is incorporated herein by reference in its entirety.

TECHNICAL FIELD

This disclosure relates to pill bottles such as bottles for holding prescription medications and in particular relates to a pill bottle having a reminder label that is configured to indicate removal of a pill from the bottle.

BACKGROUND

Most adults are currently required or advised to take nutritional supplements, vitamins, OTC, or prescription medications on a daily basis. In the busy lives of modern adults, a problem associated with daily medications is forgetfulness in taking medications at the proper time of day. For example, it is not unusual for an individual to be prescribed an antibiotic medication to be taken three times a day. Frequently, during mid-afternoon the individual may not have a clear memory of whether-or-not the mid-day medication was taken. Additionally, it is common that some individuals have to take important medications for mental health on a similar schedule, wherein forgetting to take a pill may have extremely negative consequences. The same holds true for heart medications and a whole line of significant pharmaceutical treatments.

Many efforts have been undertaken to include physical reminders on pill bottles to assist the individual taking the pill to take the correct pill at the correct time. For example, a reminder device for pill containers has been suggested, which includes complex rotatable dials manufactured within a cap for a pill bottle. One dial may include the time of day and the other dial may include the day in order to guide the consumer in correct administering of the pills. Additionally, a prescription timer or pill taking reminder has been disclosed, which includes a clock face upon a cap for the pill bottle that also includes a rotatable transparent overlying cap that can be rotated to a predetermined time upon the taking of a pill.

Many efforts have been undertaken to include physical reminders on pill bottles to assist the individual taking the pill to take the correct pill at the correct time. For example, a reminder device for pill containers has been disclosed, that includes complex rotatable dials manufactured within a cap for a pill bottle. One dial may include the time of day and the other dial may include the day in order to guide the consumer in correct administering of the pills. Additionally, U.S. Pat. No. 5,720,392 that issued on Feb. 24, 1998 to Price, also shows a prescription timer or pill taking reminder that includes a clock face upon a cap for the pill bottle that also includes a rotatable transparent overlying cap that can be rotated to a predetermined time upon the taking of a pill.

More recently, an automatic pill reminder bottle was disclosed, that utilizes an electronic timer to generate alert signals including a vibrator, a speaker, etc., all of which are installed within a conventional pill bottle between the bottle cap and the bottle container. Also, a complex device was disclosed for recording periodic medicinal dosages. The device includes front and back plates that secure between them a plurality of slide assemblies with slide locks and related apparatus for indicating three positions for each of several slides. An alternative "medication management system" is sold under the trademark "SUREPILL" and includes a sleeve that surrounds the pill bottle wherein the sleeve includes ridges and valleys between the ridges. A tinted elastic "memory ring" can be positioned in any of the valleys between the many ridges. As a user takes pill from the bottle the user repositions the memory ring down the sleeve to indicate a pill has been taken. A more recent effort marketed by a company entitled Vitality, Inc. under the trademark "GLOWCAPS" utilizes a wireless reminder light that is plugged into a 120 volt standard house alternating current outlet while a special cap is secured to the pill bottle. The reminder light both flashes visually at a predetermined time to take a pill, and simultaneously transmits signal to the "GLOWCAP" in the individual's pocket, or on a bureau to activate an increasingly intense alarm, starting with a light and progressing to a phone call. This system also coordinates communications with the pharmacy to order refills. Upon opening and closing the "GLOWCAP" on the bottle, the "GLOWCAP" signals the reminder ring to stop transmitting alerts until the next time a pill should be taken.

While such a diverse array of solutions to the problem of remembering to timely administer medications has arisen, none of these solutions has gained wide-spread usage. That is no doubt because the above-described solutions involve apparatus that are too complex and costly to be applied to the enormous numbers of pill bottles being distributed and utilized throughout the world. While some of the more modern and more expensive apparatus and systems may be effective for home-bound individuals, for those adults who have ordinary, busy schedules involving travel to and from work, to youth activities, to social and family commitments, known pill administration reminders simply have not achieved any meaningful usage.

Consequently, there is a need for an effective, efficient, low-cost pill bottle that includes an apparatus for reminding users to properly administer their medications and that overcomes the deficiencies of the prior art.

SUMMARY OF THE DISCLOSURE

Disclosed, in various embodiments are adjustable reminder label s.

The disclosure is an adjustable position reminder button for a pill bottle. The adjustable position reminder button may be manufactured as a retro-fit, adhesive add-on to be applied to an exterior wall of a pill bottle, or the reminder button may be manufactured to be integral with the bottle. The reminder button includes a thumb knob that extends beyond the exterior wall of the pill bottle so that a user may manipulate by finger contact the thumb knob between two or more positions within two or more slide notches. For example, a first slide notch closest to an opening of the bottle may be labeled "AM" to indicate a necessity of taking a pill in the morning. Upon taking a pill from the bottle in the morning, the user then slides the thumb knob to a second slide notch closest to the bottom of the bottle and labeled "PM". The user then will quickly know the morning pill has been taken and only the afternoon pill remains to be taken. After taking the afternoon pill, the user then slides the thumb knob back to the "AM" slide notch in preparation for the following day.

In an embodiment, the pill bottle includes a circumferential wall having a sealed bottom end and an open top end. The bottle is configured for holding pills within a void defined between the wall, the sealed bottom end and a removable cap. The removable cap is configured to be selectively secured to and removed from the open top end of the pill bottle. An adjustable position reminder button is secured to either an exterior surface of the circumferential wall or within the circumferential wall. The reminder button includes a mounting plate that defines a plurality of slide notches. Each slide notch includes an entry passage adjacent an indicator slot. Each entry passage is narrower than each indicator slot so that a shortest distance of an axis across the entry passage and perpendicular to a slide direction of the slide notch is less than a shortest distance of an axis across the indicator slot and perpendicular to the slide direction of the slide notch.

The reminder button can also include a thumb knob that is secured to and extends above a base plate. The thumb knob is dimensioned to have a diameter that is between about 2% and about 5% longer than the shortest distance of the axis across the entry passage. The diameter of the thumb knob is also between about 2% and about 5% less than the shortest distance of the axis across the indicator slot. In other words, the thumb knob has to "squeeze through" the entry passage to move into another slide notch. Additionally, the base plate of the reminder button is dimensioned to have a diameter at least about two percent greater than the diameter across the indicator slot. The wide base plate insures that the thumb knob protrudes through an entry passage or indicator slot while the base plate cannot pass from a bottom side through either of the entry passage or indicator slot of the slide notch defined within the mounting plate. The reminder button is secured to the pill bottle so that the thumb knob protrudes beyond the exterior surface of the circumferential wall of the pill bottle to permit movement of the thumb knob from a first slide notch through an entry passage way and into a second slide notch in coordination with removal of a pill from the bottle.

In an embodiment, provided herein is an adjustable reminder label comprising: a thermoplastic mounting plate having a substantially rectangular open housing disposed above a base frame, the housing having a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators; a thermoplastic position indicator slidably coupled to the housing and extending through the open channel, wherein the position indicator comprises: a flanged thermoplastic knob, extending above a substantially rectangular flange, the substantially rectangular knob flange having a longitudinal axis and a transverse axis perpendicular to the longitudinal axis; and a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing; and a flap hingedly coupled to the housing base frame, the flap configured to frictionally engage the housing and form a floor.

In another embodiment, provided herein is a method of forming a thermoplastic adjustable reminder label, comprising forming (e.g., by injection molding, blow molding, thermoforming etc,) a thermoplastic mounting plate having a substantially rectangular open housing disposed above a base frame, the housing having a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators; a thermoplastic position indicator, comprising a flanged thermoplastic knob, extending above a substantially rectangular flange, the substantially rectangular knob flange having a longitudinal axis and a transverse axis perpendicular to the longitudinal axis; and a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing; and a flap hingedly coupled to the housing base frame the flap configured to frictionally engage the housing and form a floor; placing the thermoplastic position indicator to be slidably coupled to the housing and extending through the open channel; closing the flap thereby forming a continuous surface having an arcuate cross section across the transverse walls of the housing; and coupling selective means (e.g. a pressure sensitive adhesive tape covered with a peeling film and other similarly selective means) for coupling the label onto a pill box.

BRIEF DESCRIPTION OF THE FIGURES

A better understanding of the adjustable reminder label s, with regard to the embodiments thereof, reference is made to the accompanying drawings, in which like numerals designate corresponding elements or sections throughout and in which.

DETAILED DESCRIPTION

Figure 1:
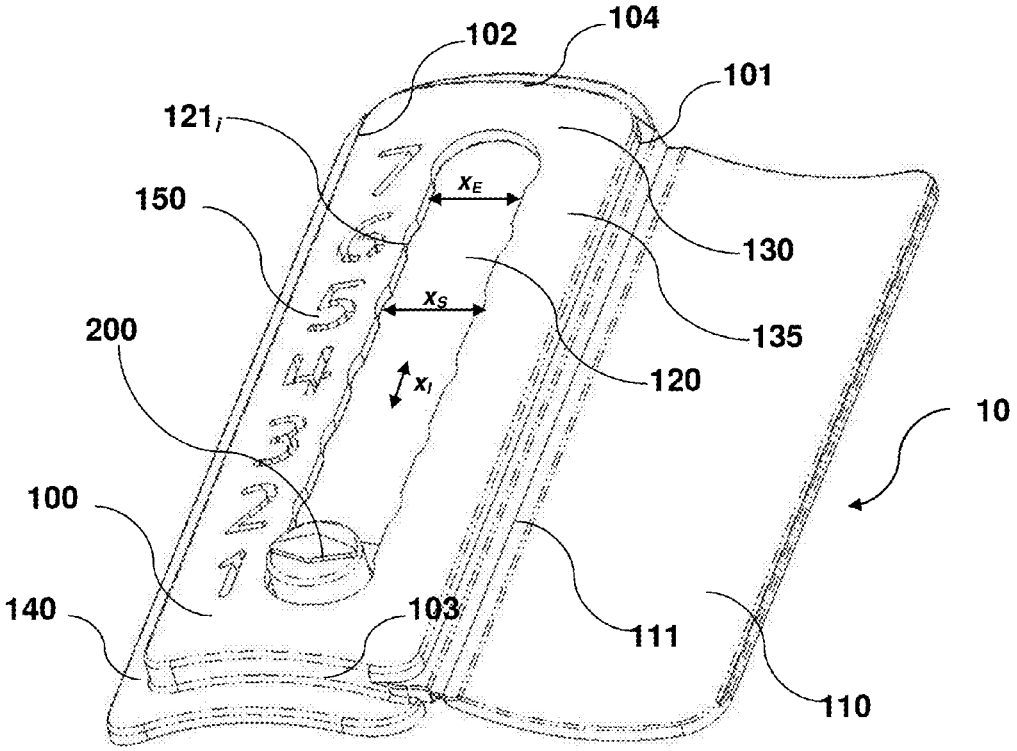
FIG. 1 is a front perspective view of an embodiment of the adjustable reminder label s in accordance with the present disclosure.

In several embodiments, provided herein are adjustable reminder label s. In another embodiment, provided herein is an adjustable reminder label comprising a slider slidably coupled to a housing defining a channel configured to provide a periodic indexed movement to the slider, wherein the slider is configured to indicate the period by both its location and by highlighting a period indicator.

The adjustable reminder label can be operably coupled to the external wall of a pill box. The reminder button can comprise a mounting plate (in other words, a flanged housing disposed over a base plate, having substantially rectangular footprint, with two parallel longitudinal walls and two parallel transverse walls, with a roof defining periodical indications and an open channel), that defines a plurality of slide notches. Each slide notch can include an entry passage adjacent an indicator slot (in other words, stacked cylinders). Each entry passage (the merged portion of the cylinder) is narrower than each indicator slot (in other words, the full circle diameter). In other words, a shortest distance of an axis across the entry passage and perpendicular to a slide direction of the slide notches is less than a shortest distance of an axis across the indicator slot and perpendicular to the slide direction of the slide notches. The adjustable position reminder button (in other words, the position indicator element), can include a flanged thumb knob that extends above a base plate flange. For example, the thumb knob (e.g., a thermoplastic oval knob) can be dimensioned to have a diameter that is between about 2% and about 5% longer than the shortest distance of an axis across the entry passage. The diameter of the thumb knob is also between about 2% and about 5% less than the shortest distance of an axis across the indicator slot. Additionally, the base plate of the reminder button can be dimensioned to have a diameter at least about two percent greater than the diameter across the indicator slot. This can provide for the thumb knob to rest easily within the indicator slot, while having to be squeezed through the entry passage to the indicator slot. In an embodiment, the wide base plate flange can ensure that the thumb knob protrudes through an entry passage or indicator slot while the base plate flange cannot pass through either of the entry passage or indicator slot from a bottom side of the slide notch defined within the mounting plate.

The reminder button can be secured to the wall of a pill bottle so that the thumb knob protrudes beyond the exterior surface of the circumferential wall of the pill bottle to permit easy movement of the thumb knob from an indicator slot of a first slide notch through an entry passage and into a second indicator slot of a second slide notch in coordination with removal of a pill from the bottle.

By having the present reminder button including its mounting plate and thumb knob secured to the base plate within the slide notches defined in the plate (or the roof of the housing), the adjustable reminder label provided herein can provide an efficient, inexpensive and durable mechanism that will 1 resist unintended movement of the thumb knob within a user's pocketbook or pocket, etc. While the reminder button maybe integrated within the wall of the pill bottle, it is anticipated that the retro-fit, stick-on embodiment of the adjustable position reminder button can be used for a variety of differing pill bottles and differing types of users. The retrofit, stick-on embodiment of the reminder button can be available in pharmacy stores for particular users to apply to a pill bottle, where other users of the same pill bottle may not need the reminder button. Likewise, the adjustable reminder label provided herein can be sold alone and be equipped with a covered adhesive tape packaged for example, in a blister pack.

For example of the retro-fit, stick-on embodiment can be for a pharmacist to apply the adjustable position reminder button directly to the original prescription bottle prior to delivering the bottle to the patient. Alternatively, the pharmacist may include the stick-on embodiment along with the prescription bottle for the patient to apply the reminder button to the original prescription bottle. By having the reminder button applied to the original prescription bottle, unlike so many known reminder apparatus, the patient can retain all of the vital prescription information and instructions on the label of the original bottle. Moreover, the original bottle may retain its own child-proof safety cap, again unlike much of the known reminder caps. This flexibility of usage and inexpensive cost to manufacture the reminder button of the adjustable reminder label provided herein can provide an excellent support for individuals regarding proper and timely administration and/or intake of their medications and nutritional supplements. An example usage of the adjustable reminder label provided herein can be for the many diabetic patients that must take insulin pills on a very precise schedule. For example, a single bottle, single-pill reminder dispensing system, method and apparatus that can overcome deficiencies of known reminder systems.

Accordingly and in an embodiment, provided here is an adjustable reminder label comprising: a thermoplastic mounting plate having a substantially rectangular open housing disposed above a base frame, the housing having a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators; a thermoplastic position indicator slidably coupled to the housing and extending through the open channel, wherein the position indicator comprises: a flanged (in other words, the term "flanged" simply meaning that there is a flange thereon) thermoplastic knob, extending above a substantially rectangular flange, the substantially rectangular knob flange having a longitudinal axis and a transverse axis perpendicular to the longitudinal axis; and a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing; and a flap hingedly coupled to the housing base frame, the flap configured to frictionally engage the housing and form a floor.

The term "slidably coupled" refers to a state in which two or more components (for example the indicator and the housing) are coupled to one another in which at least one of the components at least slides with respect to another component. The terms "slide," "slid" or "sliding" are defined as moving, gliding or passing along a surface, although continuous contact is not necessarily required. The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

"Hinge" refers to one or more parts which allow the second component to pivot with respect to the first component. "Hingedly" is intended to mean a method of mounting one component to another such that the two components can hinge or move relative to one another, and is not intended to be limited to a connection comprising an actual hinge. "Hingedly coupled" indicates that the orientation of one component relative to the other can be varied. This may be because of a connecting region which permits bending (e.g., a live hinge), or because of a form of mechanical connection that permits relative movement, for example a pivot or a hinge pin. There may be an intermediate portion which is hinged at respective spaced locations to the first and second portions, allowing a greater degree of hinging in one or more directions. A hinging device may be lockable. (It is not generally desirable for the components to undergo relative movement after the surgical procedure has been completed.) Hinged portions may be separable. Thus, the invention envisages a modular system, in which a surgeon may choose from a range of first portions and a range of second portions which can be connected together hingably.

The knob used as the thermoplastic knob in the adjustable medication label described herein can be oval, and be dimensioned to have an outer longitudinal axis diameter ($OD_L$) that is between about 2% and about 5% longer than the gap across the entry passage, and a transverse axis outer diameter ($OD_T$) that is between about 2% and about 5% less than the shortest distance of the axis across the indicator slot parallel with the sliding direction. A person skilled in the art would recognize that the shape of the knob can be varied greatly and other shapes may be used to obtain the same purpose in the same way for the same purpose. In an embodiment, the knob can be dimensioned to distort slightly when moving from one slot to the next, with the distortion being enabled by the thermoplastic knob being made of a resilient ductile material that allows such distortion, for example, an elastomer (referring to materials that extend in at least one direction when a force is applied and return to approximately their original dimensions after the force is released). For example, in any of the embodiments set forth hereinabove, the position indicator can be substantially purely elastic (e.g., resilient), or can exhibit a combination of plasticity and elasticity (e.g., compliant). In any instance where "resilient" is used, "compliant" may be substituted therefor as being a "special case" of resiliency. Moreover, as used herein, any contact structure that is compliant is resilient.

Elastic materials such as the thermoplastic position indicator described herein, when under uniaxial compression (assuming Cartesian coordinate system), in other words when under load only in the x direction (the sliding direction), resulting e.g., from pushing the knob in the sliding direction, will tend to expand in other directions (e.g., along the y and z axes). That degree of expansion is another indication of the stiffness of the thermoplastic material and is defined as the Poisson ratio. Accordingly, varying the thickness of knob and the selection of thermoplastic materials with proper Poisson ratio, may be beneficial in providing the necessary restoring action while preventing the unintentional moving of the location indicator. For example, the Poisson Ratio of the thermoplastic position indicator can be between about 0.35 and 0.5. Similarly the modulus of elasticity of the thermoplastic position indicator used in the adjustable reminder label described herein can also be varied to achieve the appropriate resistance to unintentional change in position while simultaneously providing the appropriate resiliency. The term "modulus of elasticity" or "modulus," as used in this specification and appended claims, refers to Young's modulus of elasticity (also referred to as tensile modulus of elasticity). The unit for expressing "modulus" or "modulus of elasticity" is the pascal (Pa), a unit known to persons of ordinary skill in the art (1 pascal=1 $N/m^2$, where N=Newton and m=meter). A practical unit used in this application is the megapascal (MPa; 1 MPa=$1\times10^6$ Pa). 1 MPa is approximately equal to 102 $g/mm^2$ or $1\times10^7$ $dynes/cm^2$. For example, the modulus of elasticity of the thermoplastic position indicator can be between about 0.6 and 1.5 MPa. For example, the thermoplastic position indicator can be made of low-density poly(ethylene) (LDPE), latex, polyurethane, high-density poly(ethylene) or acrylonitrile-butadiene-styrene (ABS) resin and have Shore A hardness of 25-85.

The term "ductile" used herein in accordance with common usage in the art to refer to materials that exhibit significant elongation before break and/or shear yielding in response to an applied force or load during a tensile exposure. In other words, the term "ductile" refers to materials capable of undergoing substantial deformation, e.g., during processing without breaking.

The substantially rectangular knob flange of the thermoplastic position indicator used in the adjustable reminder label described herein can be configured to remain within the housing disposed above the base frame without passing through the open channel defined in the roof of the housing and be dimensioned to have, for example a longitudinal axis that is equal to or greater (≥) than about 2% than the longest distance of the axis across the indicator slot perpendicular to the sliding direction (see e.g., dimension $x_S$ in FIG. 1).

Similarly, the label can have a length of between about 25 mm and about 60 mm, and a width of between about 15 mm and 25 mm, and may have a thickness of between about 2 mm and 15 mm from the pill box wall to the top of the knob extending through the open channel.

Moreover, the substantially rectangular knob flange of the thermoplastic position indicator used in the adjustable reminder label described herein can be configured to extend below the periodic indicator and be visible. For example, a periodic indicator, designating the periods for taking the medication (e.g., days, hours, AM, PM, times in the AM) can be an alphanumeric character etched through the roof of the housing (in other words, a cut out in the roof of the housing) and the substantially rectangular knob flange of the thermoplastic position indicator used in the adjustable reminder label described herein can be configured such that the flanged knob (or boss, referring generally to protuberance on a part designed to add strength, facilitate alignment or motion, provide fastening, provide, etc) is positioned off center in relation to a transverse centerline of the substantially rectangular knob flange, which is perpendicular to the longitudinal axis of the substantially rectangular knob flange. The larger section of the substantially rectangular knob flange can then extend below the area cut out by the alphanumeric character designating the period and be made of a material or be tinted in a way configured to be visible to the user. In an embodiment, the transverse axis of the substantially rectangular knob flange of the thermoplastic position indicator used in the adjustable reminder label described herein can be dimensioned to be equal to or greater than the height of the alphanumeric character cut out, with the proviso that its length does not extend beyond 1.5 times the height of the alphanumeric character designating the period. In an embodiment, the term "alphanumeric" refers to characters including letters, numbers, punctuation marks, machine readable codes or symbols, the like and a combination comprising one of the foregoing.

The grooves etched internally in each of the longitudinal parallel walls of the housing used in the adjustable reminder label described herein can be configured to center the knob in the slide notch. In other words, the two parallel long walls of the mounting plate housing can have depressions, or grooves spaced appropriately to engage the substantially rectangular knob flange. The term "engage" and various forms thereof, when used with reference to the adjustable reminder label described herein, refer to the application of any forces that tend to hold two members/elements together against inadvertent or undesired separating forces (e.g., such as may be introduced during unintentional moving of the knob). It is to be understood, however, that engagement does not in all cases require an interlocking connection that is maintained against every conceivable type or magnitude of separating force.

Accordingly, the pair of resilient members, each which can terminate in protrusions configured to engage the parallel grooves etched internally in each of the longitudinal parallel walls of the housing used in the adjustable reminder label described herein can be configured to flex inwardly upon sliding of the knob along the sliding direction. In other words, the resilient members (see e.g., FIG. 2, elements 230, 230') can form four (4) leaf springs (231*a*, 231*a'*, 231*b*, 231*b'*) configured to press the protrusions into the grooves in their relaxed state. The pair of resilient members can be made of the same or different resilient thermoplastic forming the thermoplastic knob and substantially rectangular knob flange. Accordingly, the grooves notched in the parallel longitudinal walls of the housing can be configured to receive at least a portion of the protrusions terminating the pair of resilient members.

The thermoplastic leaf springs forming the pair of resilient members, as well as the substantially rectangular knob flange and/or housing components, can comprise any thermoplastic material or combination of thermoplastic materials that can be formed into the desired shape and provide the desired properties. Exemplary materials include thermoplastic materials, as well as combinations of thermoplastic materials with elastomeric materials, and/or thermoset materials. Possible thermoplastic materials include at least one of the foregoing polybutylene terephthalate (PBT); acrylonitrile-butadiene-styrene (ABS); polycarbonate; polycarbonate/PBT blends; polycarbonate/ABS blends; copolycarbonate-polyesters; acrylic-styrene-acrylonitrile (ASA); acrylonitrile-(ethylene-polypropylene diamine modified)-styrene (AES); phenylene ether resins; blends of polyphenylene ether/polyamide; polyamides; phenylene sulfide resins; polyvinyl chloride PVC; high impact polystyrene (HIPS); low/high density polyethylene (L/HDPE); polypropylene (PP); expanded polypropylene (EPP); and thermoplastic olefins (TPO).

The desired properties for the thermoplastic leaf spring forming the pair of resilient members can be obtained with a thermoplastic material having Young's modulus of 0.1 to 70 GPa, for example, specifically 0.15 to 1 GPa. Additionally, the material used for the thermoplastic leaf spring can have a Poisson ratio of 0.3 to 0.5, for example, specifically 0.3 to 0.45, more specifically 0.3 to 0.35.

The adjustable reminder label described herein can comprise a flap hingedly coupled to the housing base frame, the flap configured to frictionally engage the housing and form a floor, wherein upon closing, the flap and the base plate form a continuous surface having an arcuate cross section (e.g., having a uniform radius of convex curvature) across the transverse walls of the housing. The term "frictionally engage" is broadly defined herein as causing any direct or indirect physical contact between two structures or surfaces and preferably resulting in some resistance to movement of either structure or surface. Preferably, the resistance to movement is caused by the pressing of one surface against another, so when one surface is pressed against another surface, the two surfaces are frictionally engaged or "coupled". In some specific embodiments, a locking member that is positioned within and coupled to the housing may press against the flap, such that the locking member is directly frictionally engaging the flap. In this situation, the housing and the flap are also frictionally engaged, by nature of the locking member being coupled to and positioned within the housing.

In an embodiment, the arcuate cross section has a radius of between about 10 mm and about 50 mm. However, in certain embodiments, the flexibility of the thermoplastic adjustable reminder label described herein will permit coupling the label to pill boxes having radius that is outside the range indicated and be for example between about 5 mm and 100 mm.

In an embodiment, provided herein is a method of forming a thermoplastic adjustable reminder label, comprising forming (e.g., by injection molding, blow molding, thermoforming etc,) a thermoplastic mounting plate having a substantially rectangular open housing disposed above a base frame, the housing having a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators; a thermoplastic position indicator, comprising a flanged thermoplastic knob, extending above a substantially rectangular flange, the substantially rectangular knob flange having a longitudinal axis and a transverse axis perpendicular to the longitudinal axis; and a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing; and a flap hingedly coupled to the housing base frame the flap configured to frictionally engage the housing and form a floor; placing the thermoplastic position indicator to be slidably coupled to the housing and extending through the open channel; closing the flap thereby forming a continuous surface having an arcuate cross section across the transverse walls of the housing; and coupling selective means (e.g. a pressure sensitive adhesive tape covered with a peeling film and other similarly selective means) for coupling the label onto a pill box.

In an embodiment, the reminder label can be integral to the pill bottle and be formed during the forming phase of the pill bottle itself. When forming an integral part, the reminder label may or may not have a flap to form the floor of the housing, and the wall of the pill bottle will form the floor to the housing.

A more complete understanding of the components, processes, and devices disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Figure 2:
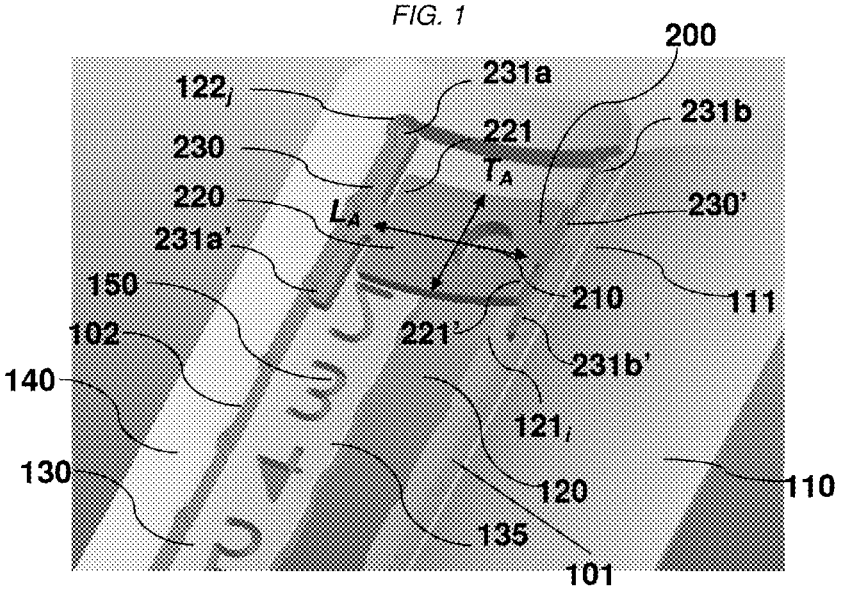
FIG. 2 is a rear perspective view of an embodiment of the adjustable reminder label s, showing slider member engaged in housing member channel.
Figure 3:
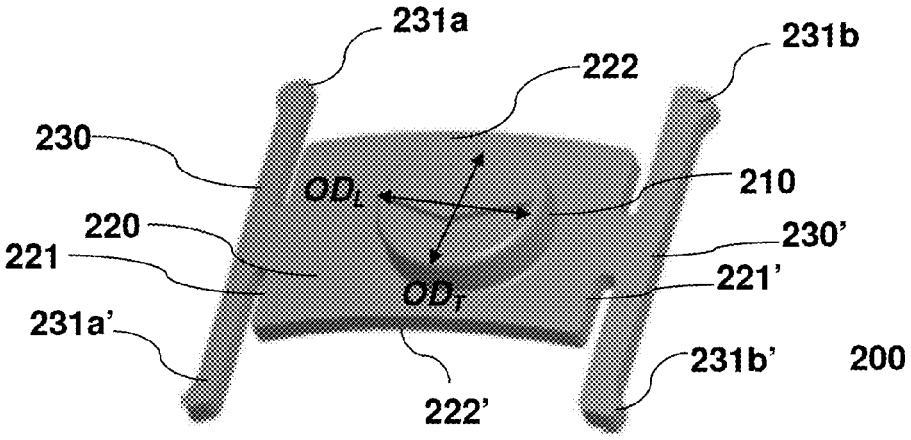
FIG. 3 is a front perspective view of an embodiment of the adjustable reminder label s, illustrating an embodiment of the thermoplastic position indicator.

Turning now to FIGS. 1-3, showing a front perspective view of an embodiment of the adjustable reminder label s in accordance with the present disclosure in FIG. 1. As shown in FIG. 1, thermoplastic, adjustable reminder label 10 can have: thermoplastic mounting plate 100 having substantially rectangular open housing 130 disposed above base frame 140, housing 130 having roof 135 connected to longitudinal parallel walls 101, 102 and transverse parallel walls 103, 104, roof 135 defining plurality of periodic indicators 150 and continuous open elongated channel 120 having plurality of slide notches $\mathbf{121}_i$, forming stacked merged circles' shape wherein each $i^{th}$ slide notch includes an entry passage having $x_E$ width and an adjacent indicator slot having $x_S$ width, wherein a shortest gap across the entry passage $x_E$ and perpendicular to a slide direction of the slide notch (in the direction of $x_I$), is less than a shortest distance of an axis across the indicator slot $x_S$ and parallel to the slide direction of the slide notch and wherein the number of indicator slots 121*i* is equal to the number of periodic indicators 150. Also shown in FIG. 1 is thermoplastic position indicator 200; and flap 110 hingedly coupled 111 to housing base frame 140 with, for example, a live hinge, flap 110 configured to frictionally engage housing 130 and form a continuous floor with base frame 140.

Turning now to FIGS. 2 and 3, illustrating in FIG. 2, thermoplastic position indicator 200 slidably coupled to housing 130 and extending through open channel 120, defined in roof 135, wherein position indicator 200 comprises: a flanged thermoplastic knob 210, extending above substantially rectangular knob flange 220, substantially rectangular knob flange 220 can have longitudinal axis ($L_A$) and transverse axis ($T_A$) perpendicular to longitudinal axis ($T_A$); and pair of resilient members 230, 230' operably coupled to substantially rectangular knob flange 220 along transverse sides 221, 221' and extending beyond transverse sides 221, 221', wherein resilient members 230, 230' each terminate in protrusions 231*a*, 231*a*', 231*b*, 231*b*' configured to engage parallel grooves 122 etched internally in each of the longitudinal parallel walls 101, 102 of housing 130; and a flap hingedly coupled to the housing base frame, the flap configured to frictionally engage the housing 130 and form a floor.

Turning now to FIG. 3, illustrating a front perspective view of an embodiment of thermoplastic position indicator 200, showing oval flanged knob or boss, 210, substantially rectangular knob flange 220, pair of resilient members 230, 230' operably coupled to substantially rectangular knob flange 220 along transverse sides 221, 221' and extending beyond transverse sides 221, 221', across longitudinal sides 222, 222' with resilient members 230, 230' each terminate in protrusions 231*a*, 231*a*', 231*b*, 231*b*', oval flanged knob having an outer longitudinal axis diameter ($OD_L$), and a transverse axis outer diameter ($OD_T$).

Figure 4:
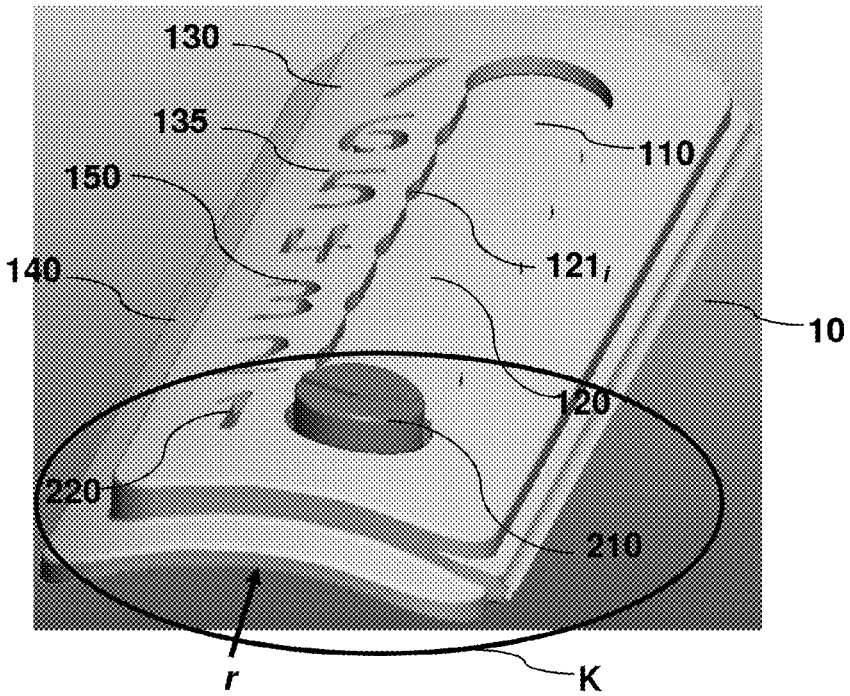
FIG. 4 is a front perspective of an embodiment of the adjustable reminder label illustrating curvature and color indication of the position indicator viewed from the periodic indicator cut-out.
Figure 5:
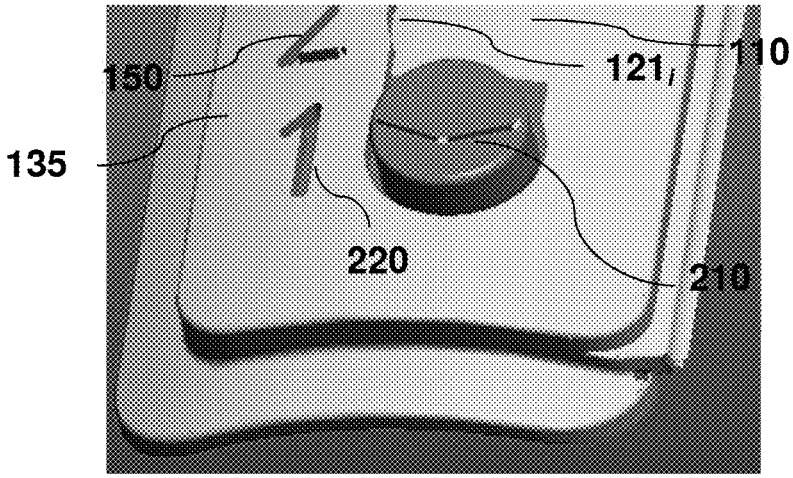
FIG. 5 is a front perspective view of an embodiment of the adjustable reminder label s, showing the enlarged portion marked in FIG. 4.
Figure 6:
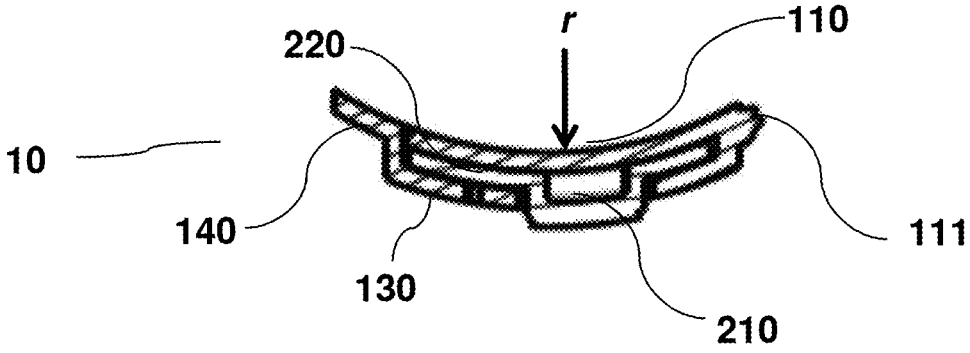
FIG. 6 is a top view of an embodiment of the adjustable reminder label, illustrating the continuous surface created by the flap and the mounting plate's housing.

Turning now to FIGS. 4-6, illustrating in FIG. 4 assembled thermoplastic adjustable reminder label 10, with thermoplastic mounting plate 100 (not shown) having substantially rectangular open housing 130 disposed above base frame 140, housing 130 having roof 135 defining plurality of periodic indicators 150 cut therethrough and continuous open elongated channel 120 having plurality of slide notches $\mathbf{121}_2$, forming stacked merged circles' shape wherein each $i^{th}$ slide notch includes an entry passage and an adjacent indicator slot, with flap 110 (not shown) closed, forming an arcuate continuous surface with radius r. Also shown in FIG. 4, is flanged knob 210 of thermoplastic position indicator 200 extending through open channel 120 defined in roof 135 of housing 130, flanged knob or boss 210 positioned off center in relation to a transverse centerline (see e.g., $T_A$ in FIG. 2) of substantially rectangular knob flange 220. The larger section of substantially rectangular knob flange 220 can then extend below numeric indicator 150 and be configured to be visible to the user as demonstrated in FIG. 5, which is an enlargement of section K in FIG. 4.

Turning now to FIG. 6, illustrating a top view of an embodiment of adjustable reminder label 10. illustrating the continuous surface created by flap 110 folded on hinge 111 and mounting plate's 100 housing base plate 140 forming an arcuate continuous surface with radius r. Also shown in FIG. 6, is flanged knob 210 of thermoplastic position indicator 200 extending through open channel 120 (not shown) defined in roof 135 (not shown) of housing 130.

Figure 7:
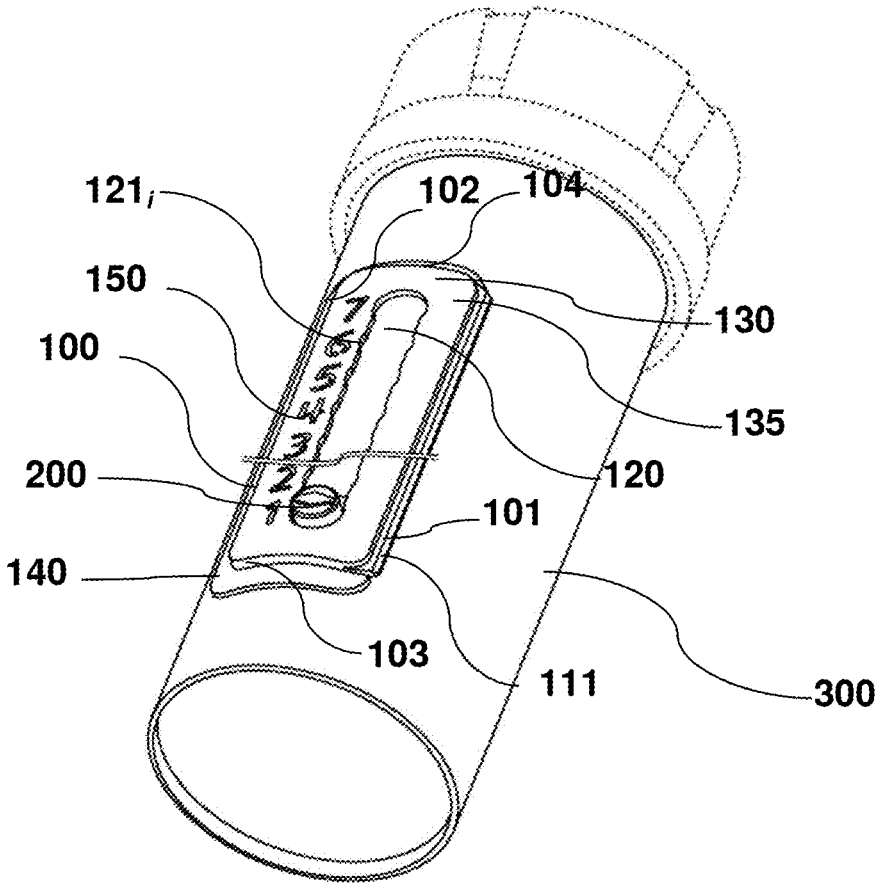
FIG. 7 shows an embodiment of the adjustable reminder label coupled to a pill bottle.

Turning now to FIG. 7, showing a front perspective view of an embodiment of the adjustable reminder label affixed to pill bottle 300. As shown in FIG. 7, thermoplastic, adjustable reminder label 10 can have: thermoplastic mounting plate 100 having substantially rectangular open housing 130 disposed above base frame 140, housing 130 having roof 135 connected to longitudinal parallel walls 101, 102 and transverse parallel walls 103, 104, roof 135 defining plurality of periodic indicators 150 and continuous open elongated channel 120 having plurality of slide notches $\mathbf{121}_i$, forming stacked merged circles' shape wherein each $i^{th}$ slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots 121*i* is equal to the number of alphanumeric periodic indicators 150. Also shown in FIG. 7 is thermoplastic position indicator 200; and flap 110 (not shown) hingedly coupled 111 to housing base frame 140 with, for example, a live hinge, flap 110 (not shown) configured to frictionally engage housing 130 and form a continuous floor with base frame 140, forming a smooth surface used to couple the reminder label to the outside wall of pill bottle 300.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combination" is inclusive of blends, mixtures, alloys, reaction products, and the like. Furthermore, the terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

The term "boss" refers to a protuberance in a component of the surgical stapler positioned providing a rigid support structure and/or point of leverage to a component. The boss may not be limited to a particular cross-section; for instance, the protuberance could have a round, square or hexagonal cross-section.

The term "selectively means" means capable of being activated. In another embodiment, the term "selective means" is meant to indicate that the means for coupling the reminder label can be activated if desired, but there is no specific requirement that coupling means is necessary for the operation of the reminder label. Other coupling means can also be used, for example double sided adhesive tapes, glue, solvents (capable of fusing the reminder label and the pill bottle and the like. Moreover, selective means is meant to indicate that the coupling of the reminder label to the pill bottle or container is not necessarily permanent and can be reusable, i.e. reused in subsequent occasions and/or that can be utilized several times and maintains similar quality as when used the first time.

In an embodiment, provided herein is an adjustable reminder label comprising: a thermoplastic mounting plate having a substantially rectangular open housing disposed above a base frame, the housing having a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators; a thermoplastic position indicator slidably coupled to the housing and extending through the open channel, wherein the position indicator comprises: a flanged thermoplastic knob, extending above a substantially rectangular flange, the substantially rectangular knob flange having a longitudinal axis and a transverse axis perpendicular to the longitudinal axis; and a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing; and a flap hingedly coupled to the housing base frame, the flap configured to frictionally engage the housing and form a floor, wherein (i) the knob is oval, dimensioned to have an outer longitudinal axis diameter ($OD_L$) that is between about 2% and about 5% longer than the gap across the entry passage, and a transverse axis outer diameter ($OD_T$) that is between about 2% and about 5% less than the shortest distance of the axis across the indicator slot parallel with the sliding direction, wherein (ii) the substantially rectangular knob flange is dimensioned to have a longitudinal axis that is equal to or greater than about two percent greater than the longest distance of the axis across the indicator slot perpendicular to the sliding direction, (iii) is configured to extend below the periodic indicator and be visible, wherein (iv) he grooves etched internally in each of the longitudinal parallel walls of the housing are configured to center the knob in the slide notch, wherein (v) the flap is hingedly coupled to the housing base frame via a live hinge, (vi) whereupon closing, the flap and the base plate form a continuous surface having an arcuate cross section across the transverse walls of the housing, (vii) with a radius of between about 10 mm and about 50 mm, (viii) wherein the arcuate continuous surface further comprises selective means for coupling the label onto a pill box, wherein (ix) the knob is positioned off center in relation to a transverse centerline of the substantially rectangular knob flange, wherein (x) the periodic indicator is an alphanumeric character etched (cut therethrough) through the roof of the housing, wherein (xi) the label has a length of between about 25 mm and about 60 mm, and a width of between about 15 mm and 25 mm, wherein (xii) the pair of resilient members operably coupled to the substantially rectangular knob flange along the transverse sides are configured to flex inwardly upon sliding of the flanged knob along the sliding direction, wherein (xiii) the grooves notched in the parallel longitudinal walls of the housing are configured to receive at least a portion of the protrusions terminating the pair of resilient members, wherein (xiv) the alphanumeric character designates a day, a month, AM, PM, or an hour, and (xv) a pill box comprising the label.

In another embodiment, provided herein is a method of forming a thermoplastic adjustable reminder label, comprising: forming a thermoplastic mounting plate having a substantially rectangular open housing disposed above a base frame, the housing having a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators; a thermoplastic position indicator, comprising a flanged thermoplastic knob, extending above a substantially rectangular flange, the substantially rectangular knob flange having a longitudinal axis and a transverse axis perpendicular to the longitudinal axis; and a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing; and a flap hingedly coupled to the housing base frame the flap configured to frictionally engage the housing and form a floor; placing the thermoplastic position indicator to be slidably coupled to the housing and extending through the open channel; closing the flap thereby forming a continuous surface having an arcuate cross section across the transverse walls of the housing; and coupling selective means for coupling the label onto a pill box, wherein (xvi) the selective means is a pressure sensitive adhesive tape covered with a peeling film, (xvii) further comprising a step of peeling the film and coupling the label onto a pill box, and wherein (xviii) the step of forming is via injection molding, blow molding, thermoforming or a combination comprising at least one of the foregoing.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed is:

1. An adjustable reminder label comprising:

a. a thermoplastic mounting plate having a substantially rectangular open housing disposed above a base frame, the housing comprising a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators;

b. a thermoplastic position indicator slidably coupled to the housing and extending through the open channel, wherein the position indicator comprises:

i. a flanged thermoplastic knob, extending above a substantially rectangular flange, the substantially rectangular knob flange having a longitudinal axis and a transverse axis perpendicular to the longitudinal axis; and ii. a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing; and c. a flap hingedly coupled to the housing base frame, the flap configured to frictionally engage the housing and form a floor.

2. The adjustable label of claim 1, wherein the knob is oval, dimensioned to have an outer longitudinal axis diameter ($OD_L$) that is between about 2% and about 5% longer than the gap across the entry passage, and a transverse axis outer diameter ($OD_T$) that is between about 2% and about 5% less than the shortest distance of the axis across the indicator slot parallel with the sliding direction.

3. The adjustable label of claim 2, wherein the knob is positioned off center in relation to a transverse centerline of the substantially rectangular knob flange.

4. The adjustable label of claim 1, wherein the substantially rectangular knob flange is dimensioned to have a longitudinal axis that is equal to or greater than about two percent greater than the longest distance of the axis across the indicator slot perpendicular to the sliding direction.

5. The adjustable label of claim 1, wherein the substantially rectangular knob flange is configured to extend below the periodic indicator and be visible.

6. The adjustable label of claim 1, wherein the grooves etched internally in each of the longitudinal parallel walls of the housing are configured to center the knob in the slide notch.

7. The adjustable label of claim 6, wherein the grooves notched in the parallel longitudinal walls of the housing are configured to receive at least a portion of the protrusions terminating the pair of resilient members.

8. The adjustable label of claim 1, wherein the flap is hingedly coupled to the housing base frame via a live hinge.

9. The adjustable label of claim 8, wherein upon closing, the flap and the base plate form a continuous surface having an arcuate cross section across the transverse walls of the housing.

10. The adjustable label of claim 9, wherein the arcuate cross section has a radius of between about 10 mm and about 50 mm.

11. The adjustable label of claim 9, wherein the arcuate continuous surface further comprises selective means for coupling the label onto a pill box.

12. The adjustable label of claim 1, wherein the periodic indicator is an alphanumeric character etched through the roof of the housing.

13. The adjustable label of claim 12, wherein the alphanumeric character designates a day, a month, AM, PM, or an hour.

14. The adjustable label of claim 1, wherein the label has a length of between about 25 mm and about 60 mm, and a width of between about 15 mm and 25 mm.

15. The adjustable label of claim 1, wherein the pair of resilient members operably coupled to the substantially rectangular knob flange along the transverse sides are configured to flex inwardly upon sliding of the flanged knob along the sliding direction.

16. A pill box comprising the adjustable reminder label of claim 1 coupled thereon.

17. A method of forming a thermoplastic adjustable reminder label, comprising:

a. forming a thermoplastic mounting plate having a substantially rectangular open housing disposed above a base frame, the housing having a roof connected to two longitudinal parallel walls and two transverse parallel walls, the roof defining a plurality of periodic indicators and a continuous open elongated channel having a plurality of slide notches wherein each slide notch includes an entry passage and an adjacent indicator slot, wherein a shortest gap across the entry passage and perpendicular to a slide direction of the slide notch is less than a shortest distance of an axis across the indicator slot and parallel to the slide direction of the slide notch and wherein the number of indicator slots is equal to the number of periodic indicators and a flap hingedly coupled to the housing base frame the flap configured to frictionally engage the housing and form a floor;

b. forming a thermoplastic position indicator, comprising a flanged thermoplastic knob, extending above a substantially rectangular flange, the substantially rectangular knob flange having a longitudinal axis and a transverse axis perpendicular to the longitudinal axis; and a pair of resilient members operably coupled to the substantially rectangular knob flange along the transverse sides and extending beyond the transverse sides, wherein the resilient members each terminate in protrusions configured to engage parallel grooves etched internally in each of the longitudinal parallel walls of the housing;

c. placing the thermoplastic position indicator to be slidably coupled to the housing and extending through the open channel;

d. closing the flap thereby forming a continuous surface having an arcuate cross section across the transverse walls of the housing; and e. coupling selective means for coupling the label onto a pill box.

18. The method of claim 17, wherein the selective means is a pressure sensitive adhesive tape covered with a peeling film.

19. The method of claim 18, further comprising a step of peeling the film and coupling the label onto a pill box.

20. The method of claim 17, wherein the step of forming is via injection molding, blow molding, thermoforming or a combination comprising at least one of the foregoing.

* * * * *